US006860301B2

(12) United States Patent
Schaffer et al.

(10) Patent No.: US 6,860,301 B2
(45) Date of Patent: Mar. 1, 2005

(54) APPARATUS AND PROCESS FOR FILLING LARGE CONTAINERS OF DIFFERENT SIZES AND SHAPES

(75) Inventors: Roland Schaffer, Linsengericht (DE); Johannes Andreas Joze Middelman, Ekeren (BE); Gerd Theodor Brand, Ronneburg (DE); Thomas Riedemann, Mömbris (DE); Frank Dieter Hünig, Karlstein (DE); Hans-Jürgen Strempel, Hainburg (DE); Hans-Joachim Seydel, Bartenheim (DE); Michael Hirschhäuser, Usingen-Eschbach (DE)

(73) Assignee: DeGussa AG, Dusseldorf (DE)

( * ) Notice: Subject to any disclaimer, the term of this patent is extended or adjusted under 35 U.S.C. 154(b) by 18 days.

(21) Appl. No.: 10/193,157

(22) Filed: Jul. 12, 2002

(65) Prior Publication Data

US 2003/0024597 A1 Feb. 6, 2003

Related U.S. Application Data

(63) Continuation-in-part of application No. 09/983,207, filed on Oct. 23, 2001, now abandoned.

(30) Foreign Application Priority Data

Jul. 11, 2001 (DE) ..... 101 33 666

(51) Int. Cl.[7] ..... B05B 1/04

(52) U.S. Cl. ..... 141/67; 141/5; 141/73; 141/252; 141/313; 141/370; 383/102

(58) Field of Search ..... 141/67, 71, 73, 141/95, 250, 252, 4–8, 270, 281, 282, 312–317, 369, 370; 229/120, 164.2, 5.81; 383/102; 220/676

(56) References Cited

U.S. PATENT DOCUMENTS

| | | | | | |
|---|---|---|---|---|---|
| 2,452,935 | A | | 11/1948 | Kemp | |
| 2,531,743 | A | | 11/1950 | Ray | |
| 2,901,007 | A | | 8/1959 | Hubbell | |
| 5,007,541 | A | | 4/1991 | Gunn et al. | |
| 5,080,702 | A | * | 1/1992 | Bosses | 55/382 |
| 5,316,056 | A | * | 5/1994 | Stott | 141/68 |
| 5,573,044 | A | * | 11/1996 | Mechalas | 141/83 |
| 5,682,929 | A | | 11/1997 | Maginot et al. | |
| 6,261,615 | B1 | * | 7/2001 | Sumpmann et al. | 426/106 |

FOREIGN PATENT DOCUMENTS

| | | | |
|---|---|---|---|
| BE | 654444 | A | 2/1965 |
| DE | 176159 | C | 10/1906 |
| DE | 3145259 | A1 | 5/1983 |
| DE | 0443349 | A1 | 8/1991 |
| DE | 19839106 | A1 | 3/2000 |
| DE | 19843430 | A1 | 3/2000 |
| EP | 0773159 | B1 | 5/1997 |
| FR | 1140249 | | 7/1957 |
| GB | 670135 | A | 4/1952 |

* cited by examiner

*Primary Examiner*—Gregory L. Huson
*Assistant Examiner*—Peter deVore
(74) *Attorney, Agent, or Firm*—Venable LLP; Thomas G. Wiseman

(57) ABSTRACT

An apparatus for filling containers, said apparatus comprising a feed nozzle which may be placed over the feed orifice of the container, the feed nozzle being so constructed that the solids may be introduced under pressure and the container being surrounded by a cage, as well as a process for filling containers, in particular with finely divided solids having a high air content by arranging an air-permeable large container in an apparatus according to the invention, air-tight connection of the large container to the feed nozzle, filling of the container under pressure, removal of the filled container and container with air-permeable plies.

19 Claims, 4 Drawing Sheets

APPARATUS AND PROCESS FOR FILLING LARGE CONTAINERS OF DIFFERENT SIZES AND SHAPES

This application is a continuation-in-part of Ser. No. 09/983,207 filed Oct. 23, 2001 now abandoned.

The present invention relates to an apparatus and a process for filling containers with granular or powdered materials, in particular with finely divided solids with a high air content, as well as to the container itself.

The handling of pourable finely divided solids having a high air content and extremely low pour density such as, for example, finely divided silica poses various problems. Producers as well as final consumers are faced with the fact that these materials raise dust even in the slightest air convection. The formation of dust must be avoided to protect the personnel dealing with the product from possible damage to their health by breathing in the dust. In addition, the low pour density increases transportation costs because the ratio of container weight to filling weight is high and a correspondingly large amount of packaging material is required.

Owing to its three-dimensional spatial branch structure, finely divided silica is a product having an extremely low compacted bulk density of about 40 to 50 g/l. Owing to its fine structure, finely divided silica is capable of binding a very large amount of gas, for example air, so the product is put into a quasi-fluid state of about 20 to 30 g/l.

Spontaneous escape of this removable air content takes place only very slowly and incompletely. The dust problem is also increased in this fluid state because the mobility of the finely divided silica is extremely high.

Pourable finely divided solids with a high air content and extremely low pour density are therefore introduced into air-permeable bags predominantly by means of an externally applied vacuum. The duration of filling increases as the air content increases.

The bags consist of three to four plies of paper, and one ply of the paper may additionally be laminated with polyethylene as a barrier against penetrating moisture. To achieve the desired air permeability during the filling process, all plies are microperforated. This has the effect that the product is compressed as it is introduced into the bag and its filling density increases relative to the natural pour density.

It is also possible to carry out preliminary deaeration using special press rollers, but this can always give rise to structural damage which may adversely affect the properties of the solids in use.

The higher proportion of the product in the container weight reduces transportation costs, but this saving is offset by additional expenditure for procuring the special container and the necessary filling devices.

A process and a receptacle for repeated filling with and emptying of pourable product having a low pouring density is known from EP-A-0 773 159. The woven fabric receptacle described therein, the so-called big bag or also super bag, consists of flexible air-permeable woven fabric, preferably a single or multiple ply of plastic woven fabric with at least one inlet. This woven fabric receptacle is also filled using vacuum filling systems. A vacuum is applied to the woven fabric receptacle and the product is aspirated through the open inlet into the woven fabric receptacle until a predetermined filling weight is achieved. The issuing gas is distributed over the entire surface of the woven fabric receptacle. During the filling process, the product is reversibly compacted, as when being poured into bags, without its structure being destroyed in the process.

DE-A-198 39 106 describes flexible large containers for finely divided solids having a high air content for repeated filling using vacuum filling systems, which consist of at least two superimposed plies, an inner ply consisting of uncoated air-permeable woven fabric and an outer ply being dustproof and being coated with a moisture barrier and these plies being mutually connected by a special seam in such a way that the container may only be aerated through it.

With this design of containers, in particular the increase in moisture in the filling product during storage in the large container could be reduced.

As the air is no longer able to escape over the entire surface of the woven fabric receptacle, however, a drawback is that the period of time required to reach a predetermined pouring density is considerably extended and the filling capacity therefore reduced. To compensate for this, the DE-A-198 39 106 describes a particular process for filling this large container, with which the filling material is subjected to preliminary deaeration prior to filling and a further deaeration via the seams of the fabric is carried out during filling. The preliminary deaeration and therefore partial compaction of the filling product are also effected by the application of vacuum.

A drawback of the process described in DE-A-198 39 106 is the extremely high expenditure on apparatus as vacuum systems are required for both preliminary compaction and filling of the large container. Despite this expenditure, the filling capacity is still too low, so the process described in DE-A-198 39 106 is uneconomical overall.

It is accordingly an object of the present invention to provide an apparatus, a container and a process for filling the containers, in particular with finely divided solids having a high air content, with which a high filling capacity with adequate compression of the solids to be poured may be achieved with low expenditure on apparatus and therefore low capital outlay.

This object is achieved with an apparatus for filling containers, in particular with finely divided solids having a high air content, comprising a feed nozzle which may be introduced into the feed orifice of the container, wherein the feed nozzle is so designed that the solids may be introduced under pressure and the container is surrounded by a two-part or multi-part cage (3).

The present invention also relates to a process for filling containers, in particular with finely divided solids having a high air content, by arranging an air-permeable container in an apparatus according to the invention, air-tight connection of the container to the feed nozzle, filling of the container under pressure and removal of the filled container.

Another subject matter of the invention is a flexible container for finely divided solids for the repeated filling and draining, characterized in that it consists of at least two ply, one above the other, wherein one play consists of an air-permeable supporting material that is preferably non-coated and the other ply consists of a filter material.

According to one embodiment of the invention, the air-permeable, supporting material can be arranged on the outside and filter material on the inside.

However, other combinations of the plies, from the inside toward the outside,are possible, wherein the combination of supporting and filtering element of the container is essential.

The container according to the invention can be designed for optional amounts of finely divided filler materials.

The container according to the invention can preferably be used for amounts up to 1,200 kg. In contrast, containers according to prior art could only accommodate filling amounts of 90 to 100 kg.

The material used for each ply can be commercially available material.

The container according to the invention permits a dust-free filling through compacting on the inside of the container, in particular using the apparatus according to the invention, wherein clearly higher bulk weights can be achieved.

The finely divided material can be drained from the container according to the invention through a preceding fluidization and simultaneous conveying.

For this, known drainage devices can be used.

The container according to the invention is shown schematically in FIG. 3.

A further subject matter of the invention is a corrugated cardboard container (carton)for finely divided materials, which can be ventilated. This container is characterized by its design, for which one side of the corrugated cardboard consists of a highly air-permeable paper and the inside undulation(s) as well as the other sides and intermediate plies consist of non air-permeable standard corrugated cardboard with a microperforation.

Optional combinations of the outer plies, the inner plies and the intermediate plies are possible, wherein the container (corrugated cardboard container) has a supporting as well as filtering design.

This results in the following advantages as compared to the known technology:

The highly air-permeable inner ply acts as a filter for the product and permits the air to escape.

The outer ply and the intermediate ply(plies) and the undulation(s) absorb the forces, but permit the air to escape. As a result of this configuration, air is moved quickly through the walls and the product can be highly compacted inside the container with considerably higher filling weights than is possible with known systems (up to 1,200 kg as compared to the known 90–100 kg, depending on the product type).

The container according to the invention is shown schematically in FIG. 5.

Finely divided solids having a high air content may be poured with adequate compression of the solids in high capacities using the apparatus according to the invention and the process according to the invention, without high expenditure on apparatus. In particular, finely divided granular powdered solids having a high air content and selected from pyrogenic oxides, precipitated oxides, carbon blacks and modifications may be poured.

In particular with pneumatic conveyance of the filling product, the resultant pressure is sufficient to achieve appropriate filling of the container. According to a preferred embodiment of the present invention, the apparatus according to the invention has a special feed nozzle which is equipped with a flexible sealing skin and therefore allows dust-free pressure filling. The feed nozzle may be deformable and may therefore allow the filling of containers of various sizes.

The cage which is an important component of the apparatus according to the invention has to withstand, in particular, the pressure required. At the same time, the cage gives the container adequate support during the filling process, to ensure that the container withstands the pressure applied and keeps its shape during the filling process.

Containers of a wide variety of shapes and of various materials may be filled in the apparatus according to the invention. The materials may be: air-permeable plastic woven fabric, preferably polypropylene woven fabric, plastic woven fabric, textile woven fabric, cardboard, paper, paper plastic woven material, plastic non-woven fabric, textile non-woven fabric or composites of the aforementioned materials. The filling pressure is generally 0 to 8 bar, preferably 0 to 2 bar and particularly preferably 0.2 to 1.2 bar.

The containers employed in the apparatus according to the invention using the process according to the invention may be of any conventional shapes and materials. For example, the containers may have a base area selected from a group consisting of polygon, circle, semicircle, ellipse, trapezium, triangle, rhombus, square and rectangle or a star-shaped base area. The containers may also have the shape of a hood, of assembled pockets or the shape of a tied-up bag. To ensure safe handling even during pressure filling, however, it is advantageous if, during the filling process, the cage contacts the container to be filled, as uniformly and snugly as possible. It is therefore expedient if the cage substantially corresponds to the shape of the container. Additional fittings in the cage allow adaptation to the respective container to be filled.

Owing to the excess pressure prevailing in the interior of the container, the air is carried off over the surface of the container. As the excess pressure is able to escape, compression of the filling product is also achieved. To enable the excess pressure to escape as rapidly as possible from the container, in particular in the case of a snugly fitting cage, it is expedient if the cage (3) itself is also gas-permeable. The cage may have walls with openings or with adequate porosity. This may be achieved, for example, by openings in the cage walls. It is particularly advantageous if the cage walls are produced from a material selected from perforated plate, mesh or netting, woven fabric or sintered material or a mesh material, because this allows high gas permeability with adequate stability to ensure that the container does not explode even under high filling pressures. The cage may be in several parts, preferably two parts. The cage (3) may have a bottom and may be designed without a bottom. Preferably, the cage (3) has no bottom.

According to a particularly preferred embodiment of the apparatus according to the invention, the cage (3) may be in two or more parts and the apparatus comprises additional devices with which the two parts **(3*a*, 3*b*)** of the cage may be separated from one another and may be driven apart manually or automatically, preferably electro-pneumatically, to release the filled container. In particular in the case of cage shapes with a polygonal base area, it is expedient if the cage can be separated along a diagonal as this prevents damage to the container.

According to a particularly preferred embodiment of the present invention, the cage has no bottom, in other words the cage is open at the bottom. This embodiment allows particularly simple management of the filling process. After the two-part cage has been closed and the two parts have been connected to one another, the actual filling process can begin. For example, the container can then be positioned directly on a plate or a pallet, the feed nozzle can then be introduced into the feed orifice of the container and can be connected in an airtight manner to the container. On completion of the filling process, the two cage wedges can then be separated from one another and driven apart to release the filled container. As the filled container is then standing on a plate or pallet, it can easily be removed by a transportation device.

The present invention will now be described again with reference to figures.

As shown in the figures, the preferred embodiment of the present invention comprises a framework 1 with two rails 2 at the top, along which the two halves 3*a* and 3*b* of the cage (3) may be moved by conventional drive devices.

Figure 1:
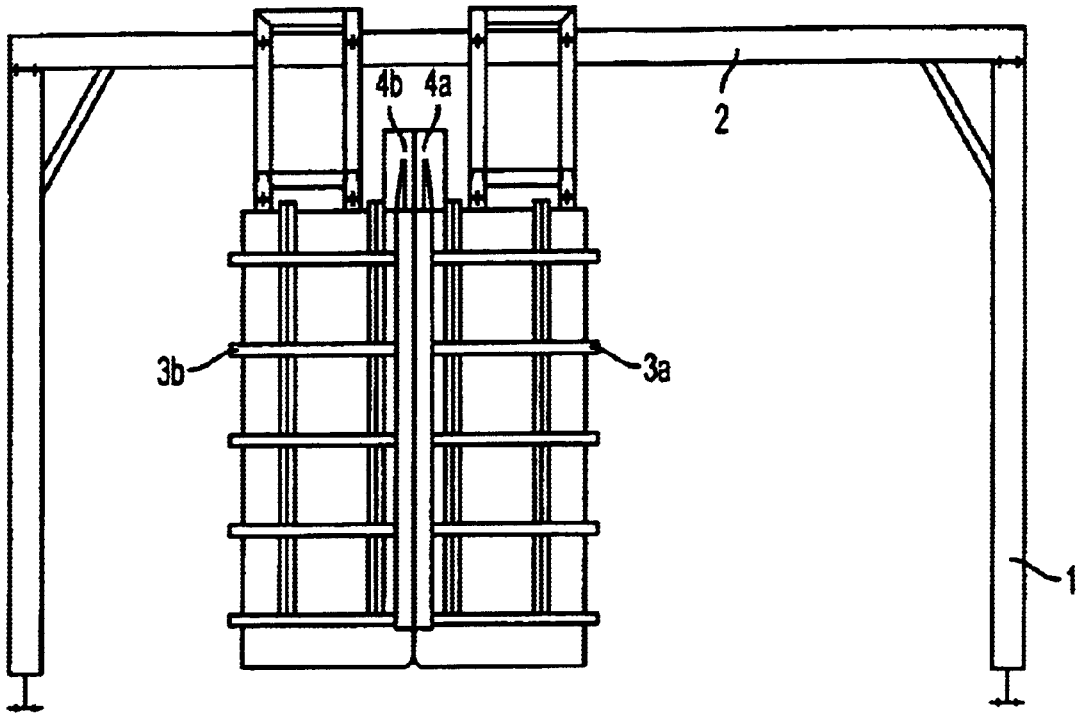
FIG. 1 is a side view of a preferred embodiment of the present invention.
Figure 2:
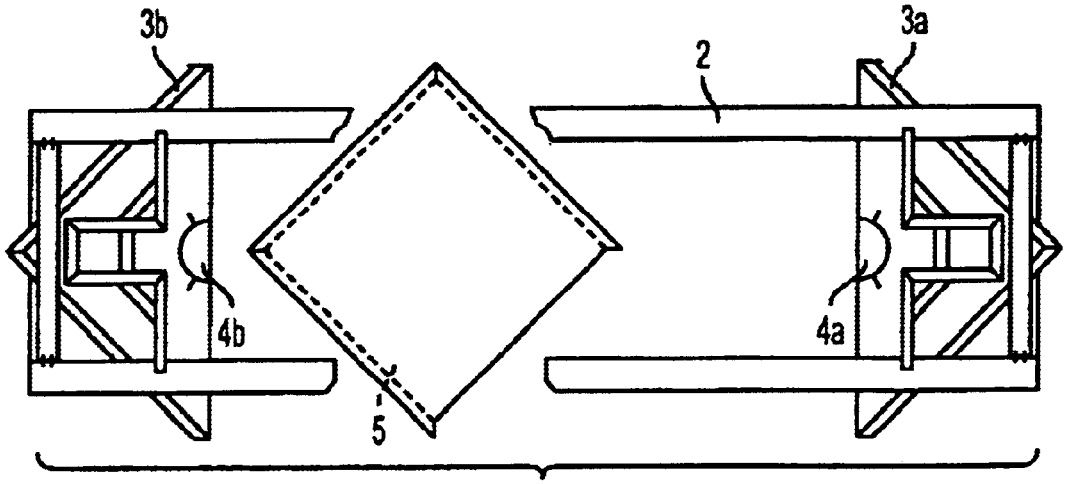
FIG. 2 is a plan view of the embodiment according to FIG. 1 with opened cage.

In the embodiment shown in FIGS. 1 and 2, the cage has a square base area and is divided along the diagonal into the two halves 3*a* and 3*b*. This ensures that the two halves can easily be separated from the filled container, even when the [sic] has been pressed against the cage owing to the high filling pressure.

The cage also has two half shells 4*a* and 4*b* which surround the feed nozzle (not shown) when closed.

As shown in FIG. 2, the cage 3 is open at the bottom and the container is positioned on a pallet or plate during the filling process. It is also advantageous, as shown in the figures, if the filling nozzle is arranged symmetrically with respect to the frame 1 so a cage half 3*a* may be removed further from the pallet or plate 5 to allow easy access, for example for a transportation device for removing the filled container.

Figure 3:
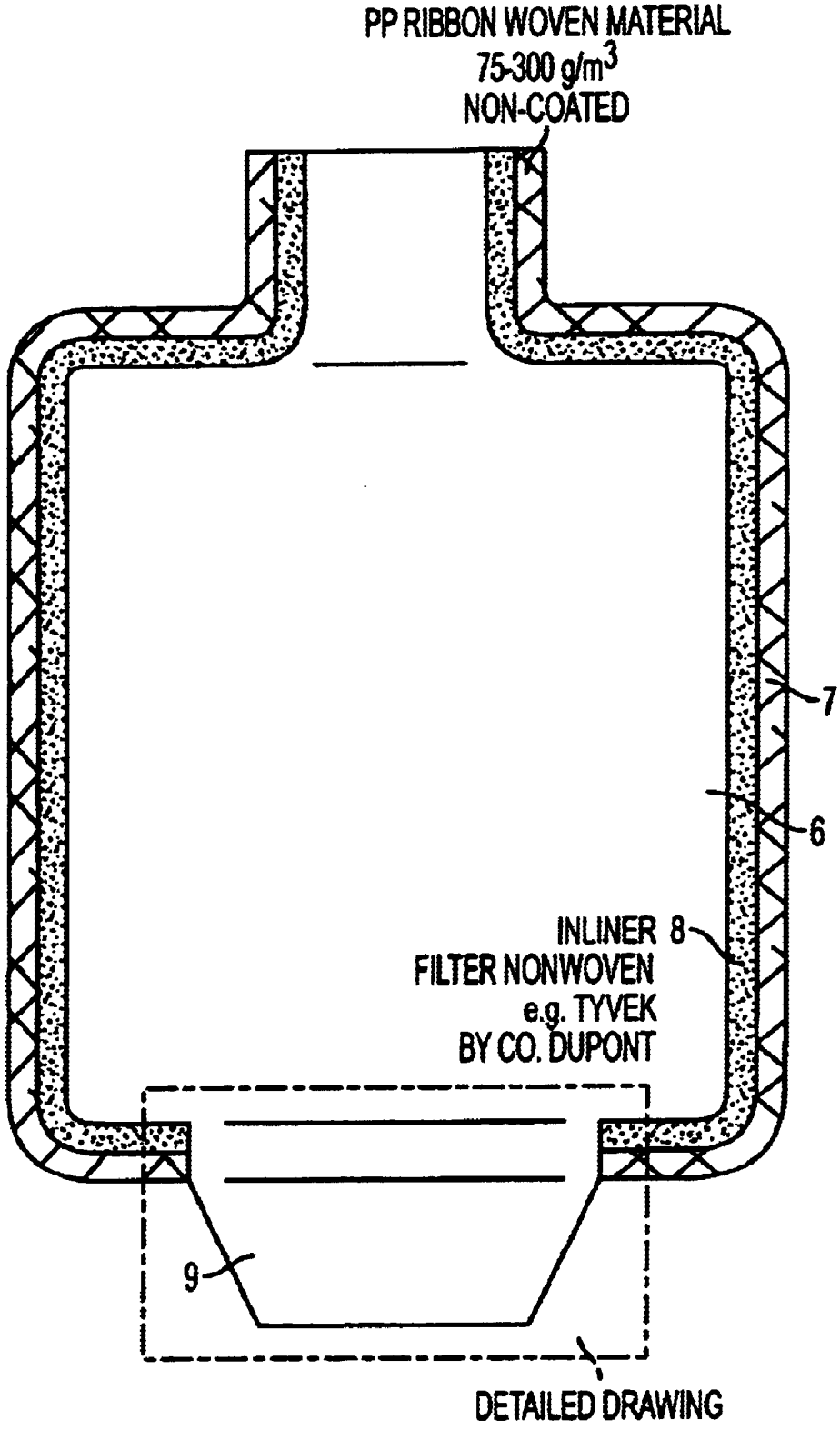

FIG. 3 shows schematically a representation of the container according to the invention.

On the one hand, the container 6 according to FIG. 3 consists of two plies, namely the supporting, air-permeable outer material 7 (PP woven ribbon material with a weight of 75 to 300 g/m$^3$).

The material is not coated so that air can pass through. This outer layer is supporting as well as carrying for product amounts up to 1,200 kg.

On the other hand, the second ply, the inner ply 8 (inliner) consists of a filter material (e.g. HDPE nonwoven "Tyvek" by DuPont, which holds back the finely divided product but permits the air escaping from the product to pass through (filter effect).

Figure 4A:
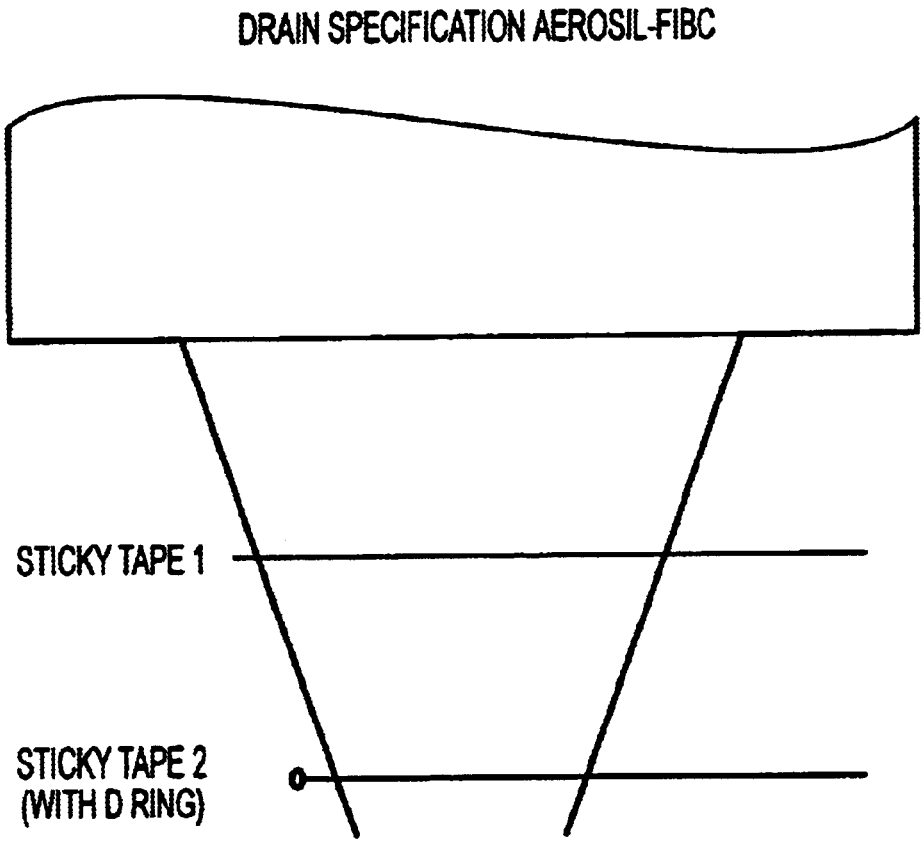
Figure 4B:
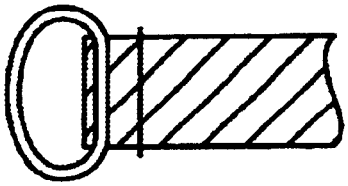
Figure 4C:
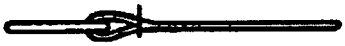

The drain 9 is shown schematically in FIG. 4. The drain has a conical design and is thus particularly suitable for a special draining apparatus according to EP 0 761 566 B1.

Figure 5:
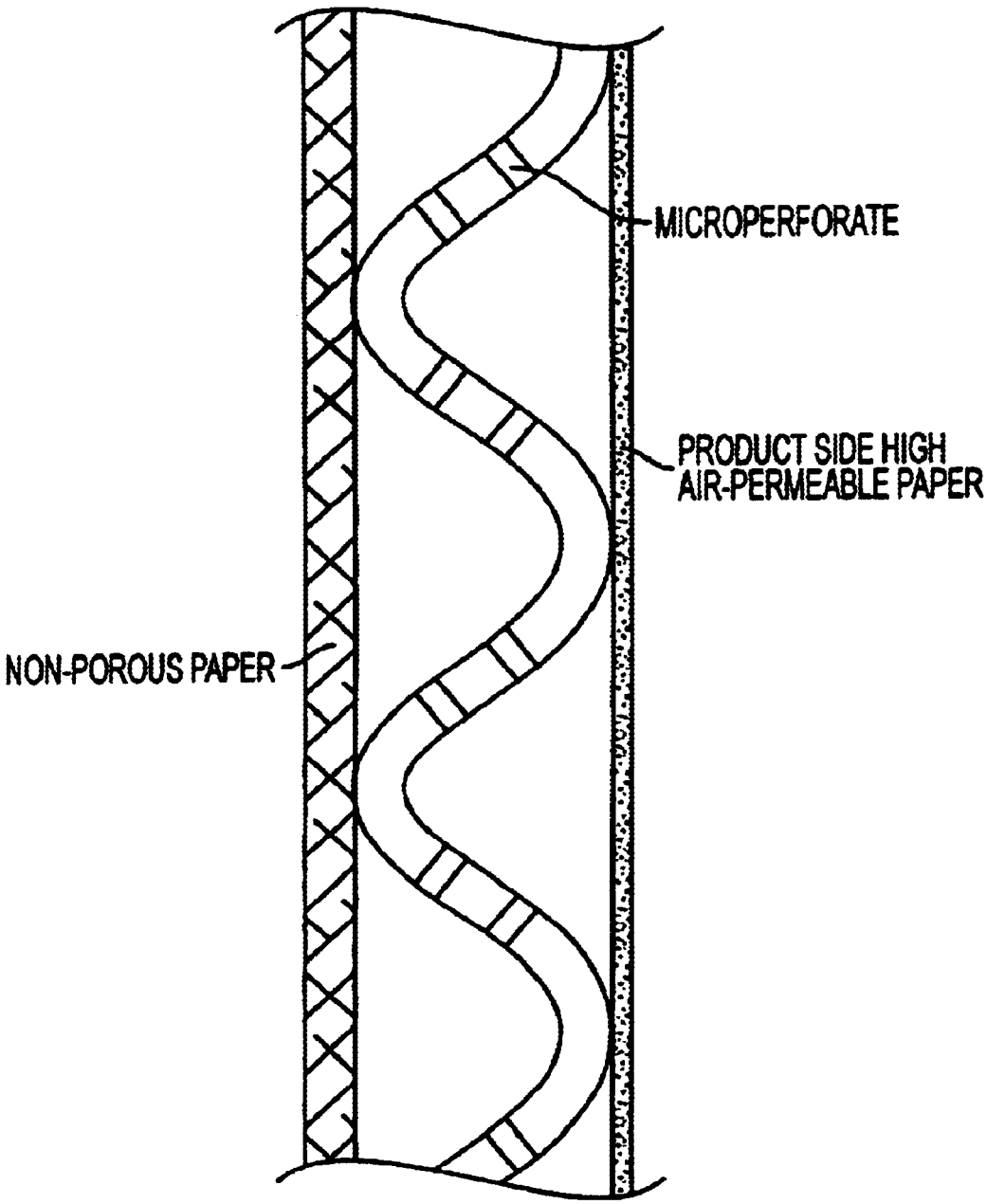

FIG. 5 shows the schematic representation of the corrugated cardboard container according to the invention.

What is claimed is:

1. An apparatus for filling containers with granular, powdered or finely divided solids having a high air content, comprising a feed nozzle which may be introduced into the feed orifice of the container, where the feed nozzle is designed to introduce the solids under positive pressure and the container is surrounded by a two-part or multi-part cage (3).

2. The apparatus according to claim 1, wherein the feed nozzle is equipped with a flexible sealing skin which allows dust-free pressure filling.

3. The apparatus according to claim 1, wherein the base area of the cage (3) has a shape selected from the group consisting of polygon, circle, semicircle, ellipse, trapezium, triangle, rhombus, square and rectangle or wherein the base area is star-shaped.

4. The apparatus according to claim 1, wherein the cage (3) has two or more parts (3*a*, 3*b*), which can be separated from one another to release the filled container.

5. The apparatus according to claim 4, wherein the separation is manual or involves drives.

6. The apparatus according to claim 1, wherein the cage (3) is gas permeable.

7. The apparatus according to claim 6, wherein the cage (3) has walls with orifices or pores.

8. The apparatus according to claim 7, wherein the walls are produced from a material selected from perforated plate, mesh, netting, woven fabric sintered material.

9. The apparatus according to claim 1, wherein the cage is designed with a bottom or without a bottom.

10. A process for filling containers with finely divided granular, powdered materials having a high air content comprising, placing an air-permeable container in an apparatus according to claim 1, connecting a feed nozzle to the container in an air-tight fashion, filling the container under positive pressure and removing the filled container.

11. The process according to claim 10, wherein the container is removed by driving the cage halves apart.

12. The process according to claim 10, wherein the container is produced from air-permeable plastic woven fabric, plastic woven fabric, textile woven fabric, cardboard, paper, paper-plastic woven fabric, plastic non-woven fabric, textile non-woven fabric or composites thereof.

13. The process according to claim 10, wherein the filling pressure is generally 0 to 8 bar.

14. The process according to claim 10, wherein the finely divided granular powdered solids having a high air content are selected from a group consisting of pyrogenic oxides, precipitated oxides, carbon black and modifications thereof.

15. The process according to claim 10, wherein the container has a base area shape selected from the group consisting of polygon, circle, semicircle, ellipse, trapezium, triangle, rhombus, square and rectangle or the base area has a star-shape or the shape of a hood, of assembled pockets or the container takes the form of a tied in bag.

16. A flexible container for the repeated filling and draining of granular, powdered or finely divided solids having a high air content, characterized in that it consists of at least two plies, wherein one ply is made of an air-permeable, supporting material and the other ply consists of a filter material, wherein the plies allow air at pressures 0.2 to 8 bar to move quickly there through and the granular, powdered or finely divided solids, having a high air content, to be highly compacted, thereby filling the container and wherein the supporting material is selected from plastic or textile woven fabric.

17. A filtering corrugated cardboard packaging carton for granular, powdered or finely divided solids, having a high air content, which can be ventilated, where one side of the carton has corrugated cardboard, which consists of a high-air permeable paper and inner undulation(s) and the other sides of the carton and intermediate plies consist of a non permeable standard corrugated cardboard with a microperforation, wherein the configuration allows air to move quickly through the walls and the granular, powdered or finely divided solids, having a high air content, to be highly compacted.

18. The process according to claim 10, wherein the filling pressure is 0 to 2 bar.

19. The process according to claim 10, wherein the filling pressure is 0.2 to 1.2 bar.

* * * * *